US008557751B2

(12) United States Patent
Yamasaki et al.

(10) Patent No.: US 8,557,751 B2
(45) Date of Patent: Oct. 15, 2013

(54) LUBRICANT COMPOSITION

(75) Inventors: Hirotaka Yamasaki, Ichihara (JP); Motoharu Ishikawa, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 168 days.

(21) Appl. No.: 12/597,600

(22) PCT Filed: Apr. 25, 2008

(86) PCT No.: PCT/JP2008/058071

§ 371 (c)(1),
(2), (4) Date: Oct. 26, 2009

(87) PCT Pub. No.: WO2008/133327

PCT Pub. Date: Nov. 6, 2008

(65) Prior Publication Data

US 2010/0126461 A1 May 27, 2010

(30) Foreign Application Priority Data

Apr. 26, 2007 (JP) ..... 2007-117653

(51) Int. Cl.

| | |
|---|---|
| ***C10M 125/04*** | (2006.01) |
| ***C10M 125/24*** | (2006.01) |
| ***C10M 169/04*** | (2006.01) |
| ***F01M 9/10*** | (2006.01) |

(52) U.S. Cl.
USPC ..... 508/149; 508/150; 508/172; 508/385; 123/196 R

(58) Field of Classification Search
USPC ..... 508/149, 150, 172, 385; 123/196 R
See application file for complete search history.

(56) References Cited

U.S. PATENT DOCUMENTS

| | | | | |
|---|---|---|---|---|
| 2,750,342 | A | 6/1956 | Mikeska et al. | |
| 5,306,436 | A | 4/1994 | Born et al. | |
| 5,463,132 | A | 10/1995 | Born et al. | |
| 2005/0107269 | A1 | 5/2005 | Yagishita et al. | |
| 2007/0155632 | A1* | 7/2007 | Hata et al. | 508/258 |
| 2008/0161215 | A1* | 7/2008 | Koshima et al. | 508/384 |

FOREIGN PATENT DOCUMENTS

| | | | |
|---|---|---|---|
| EP | 1 686 168 | A1 | 8/2006 |
| JP | 4 230691 | | 8/1992 |
| JP | 2001 354987 | | 12/2001 |
| JP | 2002 294271 | | 10/2002 |
| JP | 2004 35619 | | 2/2004 |
| JP | 2004 35620 | | 2/2004 |
| JP | 2006 63248 | | 3/2006 |
| JP | 2006063248 | * | 9/2006 |
| JP | 2007 70348 | | 3/2007 |

OTHER PUBLICATIONS

Extended Supplementary European Search Report issued on Jun. 14, 2011 in corresponding European Application No. 08 74 0873.
Chinese Office Action for application No. 200880013736.5 issued Mar. 31, 2012 with English translation.

* cited by examiner

*Primary Examiner* — Cephia D Toomer
*Assistant Examiner* — Vishal Vasisth
(74) *Attorney, Agent, or Firm* — Oblon, Spivak, McClelland, Maier & Neustadt, L.L.P.

(57) ABSTRACT

The lubricating oil composition contains a base oil, a phosphate ester derivative represented by a formula (1) below and a zinc compound. An element ratio (Zn/P) between zinc (Zn) and phosphorus (P) in the lubricating oil composition is 0.55 or more at a mole ratio.

(1)

$$(R^1\text{—}S\text{—}R^2\text{—}Y)_n\text{—}\overset{\overset{\displaystyle O}{\|}}{P}\text{—}(OH)_{3-n}$$

In the formula, Y represents S (sulfur) or O (oxygen); $R^1$ represents an organic group having 4 to 24 carbon atoms; $R^2$ represents a divalent organic group having 1 to 6 carbon atoms; and n represents an integer of 1 to 3.

5 Claims, No Drawings

LUBRICANT COMPOSITION

This application is a 371 of PCT/JP08/58071, filed Apr. 25, 2008.

TECHNICAL FIELD

The present invention relates to a lubricating oil composition to be used in an internal combustion engine such as a gasoline engine, a diesel engine and a gas engine.

BACKGROUND ART

While machines and instruments are operated, their parts make sliding contact or rotating contact with each other, so that their metal surfaces are worn. Accordingly, a lubricating oil has an important role to restrain wear of the contacting parts of machines and instruments.

However, a base oil of a lubricating oil (e.g., a vacuum distillation oil obtained from atmospheric distillation residual oil and a synthetic oil) of itself cannot exhibit a number of characteristics that are specifically required in other applications of lubricating oil compositions such as lubricating oils for an internal combustion engine and a driving system.

Accordingly, an additive plays extremely an important role in order to improve wear resistance of the lubricating oil and extend a lifetime of such instruments.

A known additive to improve wear resistance is ZnDTP (Zinc Dialkyldithiophosphate). ZnDTP is not only excellent in extreme-pressure property and wear resistance but also exhibits antioxidant capacity, anticorrosive property and load resistance capacity, whereby ZnDTP has been widely used for an engine oil as a so-called multi-functional additive.

However, although exhibiting excellent performance on one hand, ZnDTP itself degrades to generate an acid material such as sulfuric acid or phosphoric acid, so that such the acid material reacts with a base component contained in the engine oil, thereby causing a decrease in base-number thereof and shortening the lifetime of the engine oil. Accordingly, an extreme pressure agent and an antiwear agent as an alternative of ZnDTP have been desired.

For example, zinc dialkylphosphate having a specific structure is known for providing wear resistance as well as being excellent in a base number retention property under high temperature and oxidative conditions such as in an engine (see Patent Documents 1 to 3). Moreover, a specific phosphate ester compound is also known for providing excellent extreme-pressure property and wear resistance under high temperature and high load when added to an engine oil (see Patent Document 4).

Patent Document 1: JP-A-2002-294271
Patent Document 2: JP-A-2004-035619
Patent Document 3: JP-A-2004-035620
Patent Document 4: JP-A-2006-063248

DISCLOSURE OF THE INVENTION

Problems to be Solved by the Invention

However, since zinc dialkylphosphate disclosed in Patent Documents 1 to 3 is likely to result in an increase in a viscosity of the lubricating oil and generation of sludge, zinc dialkylphosphate is not satisfactory enough. Although being excellent in extreme-pressure property and wear resistance, a phosphate ester compound disclosed in Patent Document 4 does not stably express a base number retention property (long-drain capabilities).

Consequently, an object of the invention is to provide a lubricating oil composition having no deficiencies of ZnDTP, but exhibiting sufficient extreme-pressure property, sufficient wear resistance and stable base number retention property (long-drain capabilities) even under such severe conditions as high temperature and high load in an internal combustion engine and a driving machine.

Means for Solving the Problems

In order to solve the above-mentioned problems, an aspect of the invention provides lubricating oil compositions as follows.

[1] A lubricating oil composition containing: a lubricant base oil; a phosphate ester derivative represented by a formula (1) below; and a zinc compound, in which an element ratio (Zn/P) between zinc (Zn) and phosphorus (P) in the lubricating oil composition is 0.55 or more at a mole ratio.

[Chemical Formula 1]

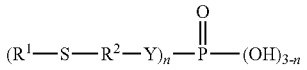

(1)

In the formula, Y represents S (sulfur) or O (oxygen); $R^1$ represents an organic group having 4 to 24 carbon atoms; $R^2$ represents a divalent organic group having 1 to 6 carbon atoms; and n represents an integer of 1 to 3.

[2] A lubricating oil composition containing: a lubricant base oil; and a phosphate ester compound that is obtained by reacting a phosphate ester derivative represented by the above formula (1) below with a zinc compound, in which an element ratio (Zn/P) between zinc (Zn) and phosphorus (P) in the lubricating oil composition is 0.55 or more at a mole ratio.

[3] The lubricating oil composition according to the above [1] or [2], in which Y in the phosphate ester derivative of the above formula (1) represents O (oxygen).

[4] The lubricating oil composition according to any one of the above [1] to [3], in which a phosphorus content is 0.12 mass % or less of the total amount of the composition.

[5] The lubricating oil composition according to any one of the above [1] to [4], in which the zinc compound is at least one compound selected from the group consisting of metal zinc, a zinc oxide, an organic zinc compound, a zinc oxoacid salt, a zinc halide and a zinc complex.

[6] The lubricating oil composition according to any one of the above [1] to [5], further containing at least one additive selected from the group consisting of a metal detergent, an ashless dispersant, a phenol and/or amine antioxidant, a metal deactivator and an anti-emulsifier.

[7] The lubricating oil composition according to any one of the above [1] to [6], in which the metal detergent is alkali metal salicylate and/or alkali earth metal salicylate.

[8] The lubricating oil composition according to any one of the above [1] to [7], in which a sulfated ash content is 1 mass % or less of the total amount of the composition.

[9] The lubricating oil composition according to any one of the above [1] to [8], in which the lubricating oil is used for an internal combustion engine.

[10] The lubricating oil composition according to the above [9], in which a sulfur content of fuel used in the internal combustion engine is 20 mass ppm or less.

The lubricating oil composition according to the aspect of the invention exhibits the same or more wear resistance and extreme pressure characteristics than a typical lubricating oil composition containing ZnDTP. Moreover, when the lubricating oil composition according to the aspect of the invention is used as an engine oil having a lowered ash content (a low initial base number) according to an exhaust aftertreatment device, the lubricating oil composition also exhibits high base number retention property, i.e., long-drain capabilities.

BEST MODE FOR CARRYING OUT THE INVENTION

A lubricating oil composition according to a first aspect of the invention includes: (A) a lubricant base oil; (B) a phosphate ester derivative represented by a formula (1) below and (C) a zinc compound. A lubricating oil composition according to a second aspect of the invention includes: (A) the lubricant base oil; and (D) a phosphate ester compound that is obtained by reacting (B) the phosphate ester derivative represented by the formula (1) below with (C) the zinc compound.

[Chemical Formula 2]

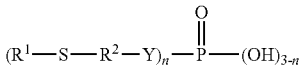

(1)

In other words, in the lubricating oil composition according to the aspects of the invention, the phosphate ester derivative of the component (B) and the zinc compound of the component (C) may be physically mixed, or the component (B) and the component (C) may be reacted to form (D) the phosphate ester compound containing zinc.

The inventions will be described in detail below.

(A) Lubricant Base Oil:

A base oil that is contained in the lubricating oil composition according the aspect of the invention is not limited. A mineral oil and a synthetic oil are usable as the lubricant base oil. The mineral oil and the synthetic oil have a variety of types and may be selected depending on the usage. Examples of the mineral oil include a paraffinic mineral oil, a naphthenic mineral oil and an intermediate mineral oil, more specifically, a light neutral oil, a medium neutral oil, a heavy neutral oil, bright stock and the like that are produced by solvent purification or hydrogenation purification. Examples of the synthetic oil include poly-α-olefins, α-olefin copolymers, polybutene, alkyl benzene, polyol esters, diacid esters, polyalcohol esters, polyoxyalkylene glycol, polyoxyalkylene glycol esters, polyoxyalkylene glycol ethers, cycloalkane compounds and the like.

Each of these lubricant base oils may be used alone or in combination of two or more. The mineral oil and the synthetic oil may be combined in use.

(B) Phosphate Ester Derivative:

In the phosphate ester derivative represented by the above formula (1), Y represents S (sulfur) or O (oxygen). $R^1$ represents an organic group having 4 to 24 carbon atoms and $R^2$ represents a divalent organic group having 1 to 6 carbon atoms. n represents an integer of 1 to 3.

In the phosphate ester derivative, $R^1$ is preferably a hydrocarbon group having 4 to 24 carbon atoms, more preferably, a hydrocarbon group having 6 to 18 carbon atoms, especially preferably, a hydrocarbon group having 8 to 12 carbon atoms. When $R^1$ is a hydrocarbon having 4 or more carbon atoms, a finally-obtained lubricating oil composition is excellent in oil solubility, extreme pressure characteristics, wear resistance, friction characteristics and lubricating performance and exhibits a low corrosivity to metals. $R^2$ is preferably a divalent hydrocarbon group having 1 to 6 carbon atoms, more preferably, an alkylene group having 2 to 4 carbon atoms, especially preferably, an ethylene group in view of availability at low cost.

Specifically, examples of $R^1$ include an alkyl group such as a butyl group, a pentyl group, hexyl groups, heptyl groups, octyl groups, nonyl groups, decyl groups, undecyl groups, dodecyl groups, tridecyl groups, tetradecyl groups, pentadecyl groups, hexadecyl groups, heptadecyl groups, octadecyl groups, nonadecyl groups and eicosyl groups; a cycloalkyl group such as a cyclohexyl group, methylcyclohexyl groups, ethylcyclohexyl groups, propylcycloalkyl groups and dimethylcycloalkyl groups; an aryl group such as a phenyl group, methyl phenyl groups, ethyl phenyl groups, propyl phenyl groups, trimethyl phenyl groups, butyl phenyl groups and naphthyl groups; and an aryl alkyl group such as a benzyl group, phenyl ethyl groups, methyl benzyl groups, phenyl propyl groups and a phenyl butyl group.

In the above formula (1), $R^2$ is preferably a hydrocarbon group having 1 to 6 carbon atoms, particularly preferably, an alkylene group having 1 to 4 carbon atoms. Specifically, examples of $R^1$ include a divalent aliphatic group such as a methylene group, an ethylene group, 1,2-propylene group, 1,3-propylene group, butylene groups, pentylene groups and hexylene groups; and an alicyclic group having two binding positions in an alicyclic hydrocarbon such as phenylene groups, cyclohexane and methyl cyclopentane.

In the above formula (1), Y represents S (sulfur) or O (oxygen) and at least one S is contained. n represents an integer of 1 to 3, preferably 1 or 2, more preferably 2. However, Y is preferably O (oxygen) in view of stability of the compound, consequently, long-drain capabilities of the composition.

Examples of the phosphate ester derivative mentioned above include tri(hexylthioethyl) phosphate ester, tri(octylthioethyl) phosphate ester, tri(dodecylthioethyl) phosphate ester, tri(hexadecylthioethyl) phosphate ester, di(hexylthioethyl) phosphate ester, di(octylthioethyl) phosphate ester, di(dodecylthioethyl) phosphate ester, di(hexadecylthioethyl) phosphate ester, mono(hexylthioethyl) phosphate ester, mono(octylthioethyl) phosphate ester, mono(dodecylthioethyl) phosphate ester, mono(hexadecylthioethyl) phosphate ester, tri(hexylthiopropyl) phosphate ester, tri(octylthiopropyl) phosphate ester, tri(dodecylthiopropyl) phosphate ester, tri(hexadecylthiopropyl) phosphate ester, di(hexylthiopropyl) phosphate ester, di(octylthiopropyl) phosphate ester, di(dodecylthiopropyl) phosphate ester, di(hexadecylthiopropyl) phosphate ester, mono(hexylthiopropyl) phosphate ester, mono(octylthiopropyl) phosphate ester, mono(dodecylthiopropyl) phosphate ester, mono(hexadecylthiopropyl) phosphate ester, tri(hexylthiobutyl) phosphate ester, tri(octylthiobutyl) phosphate ester, tri(dodecylthiobutyl) phosphate ester, tri(hexadecylthiobutyl) phosphate ester, di(hexylthiobutyl) phosphate ester, di(octylthiobutyl) phosphate ester, di(dodecylthiobutyl) phosphate ester, di(hexadecylthiobutyl) phosphate ester, mono(hexylthiobutyl) phosphate ester, mono(octylthiobutyl) phosphate ester, mono(dodecylthiobutyl) phosphate ester, and mono(hexadecylthiobutyl) phosphate ester.

A manufacturing method of the phosphate ester derivative represented by the above formula (1) is not particularly limited. However, a method of reacting hydrocarbylthio alcohol represented by a formula (2) below with phosphorus pentoxide represented by a formula (3) below is preferably applicable.

$$R^1—S—R^2—OH \quad (2)$$

$$P_2O_5 \quad (3)$$

In the formula (2), $R^1$ and $R^2$ are the same as in the formula (1). When $R^1$ is a hydrocarbon having 18 or less carbon atoms, the yield of the reaction product is not decreased, thereby providing a favorable production efficiency.

A ratio in use of alcohol represented by the above formula (2) and phosphorus pentoxide represented by the above formula (3) is typically approximately 2:1 to 6:1 at a mole ratio, the most preferably 3:1. A reaction temperature is typically approximately from 15 to 140 degrees C., preferably from 30 to 110 degrees C., more preferably from 70 to 100 degrees C. The reaction is preferably performed with stirring. A solvent may be used in the reaction. Examples of the solvent are toluene, pentane, hexane, heptane and octane.

(C) Zinc Compound:

The zinc compound of the component (C) is preferably exemplified by metal zinc, a zinc oxide, an organic zinc compound, a zinc oxoacid salt, a zinc halide, a zinc complex and an organic acid zinc salt. Specifically, the zinc compound is exemplified by a zinc oxide, a zinc hydroxide, a zinc carbonate, dimethyl zinc, diphenyl zinc and a zinc complex.

The organic acid zinc salt is preferably exemplified by an alkyl or alkenyl carboxylic acid zinc salt, an alkyl or alkenyl phenyl carboxylic acid zinc salt and the like. Specifically, the organic acid zinc salt is exemplified by zinc oleate, zinc isostearate, zinc stearate, the alkyl phenyl carboxylic acid zinc salt and an alkyl salicylic acid zinc salt.

In preparing the lubricating oil composition according to the first aspect of the invention, the phosphate ester derivative (B) and the zinc compound (C) may be initially mixed to provide an additive composition, followed by addition to the lubricant base oil (A). At that time, the component (B) and the component (C) may cause a chemical reaction to form a compound containing zinc and phosphorus. Alternatively, the component (B) and the component (C) may be separately added to the lubricant base oil (A).

In the first exemplary embodiment of the invention, an amount of the component (B) is preferably from 0.005 to 1 mass % in terms of phosphorus based on a total amount of the composition, more preferably from 0.01 to 0.5 mass %.

When the amount of the component (B) is less than 0.005 mass % in terms of phosphorus, extreme-pressure property and wear resistance are unfavorably decreased. In contrast, when the amount of the component (B) exceeds 1 mass %, base-number retention property is unfavorably decreased.

An amount of the component (C) is preferably from 0.006 to 1.2 mass % in terms of zinc based on the total amount of the composition, more preferably from 0.012 to 0.6 mass %. When the amount of the component (C) is less than 0.006 mass %, base-number retention property is unfavorably decreased. In contrast, when the amount of the component (C) exceeds 1.2 mass %, solubility in the base oil is unfavorably decreased.

(D) Phosphate Ester Compound:

The phosphate ester compound of the component (D) that is contained in the lubricating oil composition according the second aspect of the invention is obtainable by reacting the phosphate ester derivative (B) with the zinc compound (C) mentioned above in absence or presence of a catalyst. In this reaction, a ratio of the phosphate ester derivative to the zinc compound in use, i.e. a mole ratio of the phosphate ester derivative to 1 mole of the zinc compound is typically from 0.1 to 5.0 mole, preferably from 1 to 3 mole, more preferably from 1 to 2.5 mole. Particularly, it is preferable to mix one molecule or more of the zinc compounds relative to 2 molecules of the phosphate ester derivative. The reaction is typically performed in a range of room temperature to 200 degrees C., preferably 40 to 150 degrees C. A solvent such as xylene, toluene and hexane is usable in performing the reaction.

Further, the phosphate ester compound (D) may be manufactured, for example, by adding an oil-soluble zinc compound such as the organic acid zinc salt when preparing the lubricating oil composition for engine oils.

In the second aspect of the invention, an amount of the phosphate ester compound (D) is preferably from 0.005 to 1 mass % in terms of phosphorus based on a total amount of the composition, more preferably from 0.01 to 0.5 mass %. When the amount of the phosphate ester compound is less than 0.005 mass % in terms of phosphorus, wear resistance is unfavorably decreased. When the amount of the phosphate ester compound exceeds 1 mass %, decrease of the base number is promoted, thereby deteriorating long-drain capabilities.

In both the first and second aspects of the invention, a ratio (Zn/P) between zinc (Zn) and phosphorus (P) in the finally-obtained lubricating oil composition is required to be 0.55 or more at the mole ratio. When Zn/P is less than 0.55, base number retention property is not sufficient. Zn/P is preferably 0.56 or more, more preferably 0.58 or more. In contrast, when Zn/P exceeds 1, solubility in the base oil is unfavorably decreased.

An amount of phosphorus based on the total amount of the composition is preferably 0.12 mass % or less, more preferably 0.08 mass % or less, further preferably 0.06 mass % or less. When the amount of phosphorus exceeds 0.12 mass %, catalyst poisoning is unfavorably caused when an exhaust aftertreatment device is used. In contrast, when the amount of the phosphorus is less than 0.005 mass %, wear resistance is unfavorably decreased.

In the lubricating oil composition according to the aspect of the invention, a sulfated ash content is preferably 1 mass % or less, more preferably 0.6 mass % or less. When the sulfated ash content exceeds 1 mass %, for example, use of the lubricating oil composition containing such a sulfated ash content as an engine oil may adversely affect the exhaust aftertreatment device. The sulfated ash content is measured based on JIS (Japanese Industrial Standard) K 2272.

Generally, however, when the lubricating oil composition contains such a low ash content, an initial base number becomes low, thereby deteriorating long-drain capabilities of the lubricating oil composition used as an engine oil. In contrast, since the lubricating oil composition of the invention contains the specific phosphate ester compound as the component (D) as mentioned above and further has the element ratio of Zn/P in the lubricating oil composition of 0.55 or more, the lubricating oil composition of the invention exhibits high base number retention property and excellent long-drain capabilities even in the low ash content range.

The lubricating oil composition of the aspect of the invention contains preferably at least one additive selected from the group consisting of a metal detergent, an ashless dispersant, a phenol and/or amine antioxidant, a metal deactivator and an anti-emulsifier.

Examples of the metal detergent include alkali metal salicylates, alkali earth metal salicylates, alkali earth metal sulfonates and alkali earth metal phenates. Specifically, the examples include calcium salicylate, magnesium salicylate, calcium sulfonate, magnesium sulfonate, barium sulfonate, calcium phenate, barium phenate, lithium salicylate, sodium salicylate, potassium salicylate, lithium sulfonate, sodium sulfonate, potassium sulfonate, lithium phenate, sodium phenate and kalium phenate. Alkali metal salicylates and alkali earth metal salicylates are particularly preferable among the above metal detergents because they exhibit high base number retention property.

It is preferable that alkali metal salicylates and/or alkali earth metal salicylates respectively contain alkali metal and/or alkali earth metal of 0.02 to 0.6 mass % based on the total amount of the composition.

Examples of the ashless dispersant include an ashless dispersant based on succinimides, succinamides, benzylamines and boron derivatives thereof and esters. Particularly, succinimide compounds substituted by an alkyl or alkenyl group having a number average molecular weight of 200 to 5000 and boron derivatives thereof are preferable.

Such a boron derivative of the succinimide compound can be obtained by, for instance, reacting a succinic acid substituted by an alkyl or alkenyl group having the number average molecular weight of 200 to 5000 or an anhydride of the succinic acid with polyalkylene polyamine and a boron compound. When the molecular weight of the alkyl or alkenyl group is less than 200, the finally-obtained boron derivative of the succinimide compound may not be sufficiently dissolved in the lubricant base oil. When the molecular weight is more than 5000, the succinimide compound may become so highly viscous as to impair the usability.

The ashless dispersant is preferably contained with a content of 0.2 to 8 mass % of the total amount of the composition.

Examples of the phenol antioxidant include octadecyl-3-(3,5-di-tert-butyl-4-hydroxyphenyl)propionate; 4,4'-methylenebis(2,6-di-t-butylphenol); 4,4'-bis(2,6-di-t-butylphenol); 4,4'-bis(2-methyl-6-t-butylphenol); 2,2'-methylenebis(4-ethyl-6-t-butylphenol); 2,2'-methylenebis(4-methyl-6-t-butylphenol); 4,4'-butylidenebis(3-methyl-6-t-butylphenol); 4,4'-isopropylidenebis(2,6-di-t-butylphenol); 2,2'-methylenebis(4-methyl-6-nonylphenol); 2,2'-isobutylidenebis(4,6-dimethylphenol); 2,2'-methylenebis(4-methyl-6-cyclohexylphenol); 2,6-di-t-butyl-4-methylphenol; 2,6-di-t-butyl-4-ethylphenol; 2,4-dimethyl-6-t-butylphenol; 2,6-di-t-amyl-p-cresol; 2,6-di-t-butyl-4-(N,N'-dimethylaminomethylphenol); 4,4'-thiobis(2-methyl-6-t-butylphenol); 4,4'-thiobis(3-methyl-6-t-butylphenol); 2,2'-thiobis(4-methyl-6-t-butylphenol); bis(3-methyl-4-hydroxy-5-t-butylbenzyl)sulfide; bis(3,5-di-t-butyl-4-hydroxybenzyl) sulfide; n-octyl-3-(3,5-di-t-butyl-4-hydroxyphenyl) propionate; n-octadecyl-3-(3,5-di-t-butyl-4-hydroxyphenyl) propionate; and 2,2'-thio [diethyl-bis-3-(3,5-di-t-butyl-4-hydroxyphenyl)propionate]. A bisphenol antioxidant and an ester group-containing phenol antioxidant are particularly preferable among the above.

Examples of the amine antioxidant include an antioxidant based on monoalkyldiphenylamine such as monooctyldiphenylamine and monononyldiphenylamine; dialkyl diphenylamine such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamine such as tetrabutyldiphenylamine, tetrahexyldiphenylamine, tetraoctyldiphenylamine and tetranonyldiphenylamine; and naphthylamine, specifically α-naphthylamine, phenyl-α-naphthylamine and alkyl-substituted phenyl-α-naphthylamine such as butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine. A dialkyl diphenylamine antioxidant and a naphthylamine antioxidant are preferable among the above.

A content of the antioxidant is preferably 0.3 mass % or more of the total amount of the composition, more preferably 0.5 mass % or more. On the other hand, when the content exceeds 5 mass %, the antioxidant may not be dissolved in the lubricant base oil. Accordingly, the content of the antioxidant is preferably in a range of 0.3 to 5 mass % of the total amount of the composition.

Examples of the metal deactivator (copper corrosion inhibitor) include benzotriazole-based compounds, tolyltriazole-based compounds, thiadiazole-based compounds, imidazole-based compounds and pyrimidine-based compounds. Among the above, the benzotriazole-based compounds are preferable. The metal deactivator added in the lubricating oil composition restrains the engine parts from being metallically corroded and degraded due to oxidation. In view of blending effects, a content of the metal deactivator is preferably from 0.01 to 0.1 mass % of the total amount of the composition, more preferably from 0.03 to 0.05 mass %.

The anti-emulsifier is typically a surfactant which is exemplified by a nonionic surfactant based on polyalkylene glycol such as polyoxyethylenealkylether, polyoxyethylenealkylphenylether and polyoxyethylenealkylnaphthylether.

Further, the lubricating oil composition of the invention may contain a rust inhibitor and an antifoaming agent.

Examples of the rust inhibitor include petroleum sulfonate, alkylbenzene sulfonate, dinonylnaphthalene sulfonate, alkenyl succinic ester and multivalent alcohol ester. In view of blending effects, a content of the rust inhibitor is typically approximately from 0.01 to 1 mass % of the total amount of the composition, preferably from 0.05 to 0.5 mass %.

Examples of the antifoaming agent include silicone oil, fluorosilicone oil and fluoroalkylether. In view of a balance between antifoaming effects and cost, a content of the antifoaming agent is preferably approximately 0.0005 to 0.1 mass % of the total amount of the compound.

As an antiwear agent other than the component (D) used in the invention, a metal thiophosphate (Zn, Pb, Sb and the like), a metal thiocarbamate (Zn and the like), a sulfur compound, a phosphate ester and a phosphite ester may be used in combination. Such an antiwear agent is preferably used at a rate of 0.05 to 5 mass % of the total amount of the composition.

Because of being excellent in wear resistance, extreme-pressure property and further long-drain capabilities, the lubricating oil composition of the aspect of the invention is preferably usable as a lubricating oil for an internal combustion engine such as a gasoline engine, a diesel engine and a gas engine for a motorcycle, a four-wheel vehicle, electric power generation, a vessel and the like.

The lubricating oil composition of the aspect of the invention is particularly suitable for an internal combustion engine using fuel that contains a sulfur content of 20 mass ppm or less. In general, lubricating performance of the lubricating oil is particularly required when the sulfur content of the fuel is as low as 20 mass ppm or less. When lubricating performance is insufficient, a defective phenomenon such as seizure may occur in an engine. However, the lubricating oil composition of the invention maintains excellent lubricating performance for a long period and exhibits sufficient long-drain capabilities even in the internal combustion engine using the above low-sulfur-containing fuel.

EXAMPLES

Next, the invention will be described in detail by reference to Examples, which by no means limit the invention.

Specifically, phosphate ester compounds (Manufacturing Examples 1 to 3) of the component (D) of the lubricating oil composition according to the aspect of the invention and an organic acid zinc salt for a boost (Manufacturing Example 4) as a comparative were manufactured. Then the compounds obtained by these Manufacturing Examples were used to prepare lubricating oil compositions and various evaluations thereof were made.

Manufacturing Example 1

To a 1000-ml flask, 200 ml of hexane, 114.2 g (0.60 mol) of octylthioethanol and 28.4 g (0.20 mol) of phosphorus pentoxide were put to react at 70 degrees C. for 16 hours. Cooled down to room temperature, 172 g of a mineral oil for diluting and 29.3 g (0.36 mol) of zinc oxide were added to react at 100 degrees C. for 2 hours. The reactant was filtered. Hexane was distilled off to obtain 327 g of the product (phosphate ester compound A).

Manufacturing Example 2

To a 1000-ml flask, 200 ml of toluene, 147.7 g (0.60 mol) of dodecylthioethanol and 28.4 g (0.20 mol) of phosphorus pentoxide were put to react at 60 degrees C. for 7 hours. Cooled down to room temperature, 172 g of a mineral oil for diluting and 29.3 g (0.36 mol) of zinc oxide were added to react at 100 degrees C. for 2 hours. The reactant was filtered. Toluene was distilled off to obtain 187 g of the product (phosphate ester compound B).

Manufacturing Example 3

In the same manner as Manufacturing Example 1 except that the amount of zinc oxide is 16.3 g (0.20 mole), 316 g of the product (phosphate ester compound C) was obtained.

Manufacturing Example 4

To a 500-ml flask, 113.6 g (0.4 mol) of stearic acid, 16.2 g (0.2 mol) of zinc oxide, 0.05 L of toluene and 2 g of water were put to react at 70 degrees C. for 3 hours. After toluene and water were vacuum-distillized, the residue was diluted with 30 g of a mineral oil equivalent to 150N. The reactant was filtered. A yield of the obtained reaction product (an organic acid zinc salt for a booster) was 148 g.

Examples 1 to 5 and Comparatives 1 to 5

Lubricating oil compositions containing components shown in Tables 1 and 2 were prepared, which were then subjected to a NOx resistance test, FALEX load resistance characteristics test and shell wear test. The components, other than the compounds obtained in the above Manufacturing Examples, used for preparing the lubricating oil compositions were as follows.

(1) Lubricant base oil A: a hydrorefining mineral oil (100N) of a kinematic viscosity at 100 degrees C. of 4.5 $mm^2/s$ and a sulfur content of 0.0 mass %;

(2) Lubricant base oil B: a hydrorefining mineral oil (500N) of a kinematic viscosity at 100 degrees C. of 10.9 $mm^2/s$ and a sulfur content of 0.01 mass % or less;

(3) Anti-wear agent A: secondary zinc dialkyldithiophosphate of phosphorus content of 8.2 mass % and zinc content of 9.0 mass %;

(4) Anti-wear agent B: dibutyl phosphate ester;

(5) Metal detergent A: calcium salicylate of a calcium content of 6.0 mass % and a base number of 170 mg/KOH (perchloric acid method);

(6) Metal detergent B: calcium salicylate of a calcium content of 2.35 mass % and a base number of 17 mg/KOH (perchloric acid method);

(7) Metal detergent C: calcium salicylate of a calcium content of 7.8 mass % and a base number of 225 mg/KOH (perchloric acid method);

(8) Ashless dispersant A: polybutenyl succinimide of a nitrogen content of 0.97 mass %;

(9) Ashless dispersant B: polybutenyl succinimide of a nitrogen content of 1.57 mass %;

(10) Ashless dispersant C: borated polybutenyl succinimide of a nitrogen content of 1.76 mass % and a boron content of 2.0 mass %;

(11) Antioxidant: a mixture of dialkyldiphenyl amine and a hindered phenol antioxidant;

(12) Viscosity index improver A: PMA (polymethacrylate);

(13) Viscosity index improver B: OCP (olefin copolymer);

(14) Pour point depressant: PMA (polymethacrylate); and

(15) Others

Examples 1, 2 and Comparatives 1, 2: a metal deactivator and an antifoaming agent; and Examples 3 to 5 and Comparatives 3 to 5: a metal deactivator, an antifoaming agent and an anti-emulsifier.

Measurement of properties, the NOx resistance test, FALEX load resistance characteristics test and shell wear test were conducted on each of the lubricating oil compositions in the following manner.

(Sulfated Ash Content)

Measurement was conducted based on JIS K2272.

(Phosphorus Content)

Measurement was conducted based on JPI-5S-38-92.

(Zinc Content)

Measurement was conducted based on JPI-5S-38-92.

[NOx Resistance Test]

To 250 ml of a sample oil (lubricating oil composition), nitric oxide (NO) gas having a concentration of 8000 mass ppm and air were respectively blown at 6 L/hr in presence of iron and copper catalysts (a specimen of an oxidation test JIS K-2514). While maintaining the sample oil temperature at 140 degrees C., a base number (hydrochloric acid method) when forced to be degraded was measured.

Less decrease in the base number suggests that the lubricating oil exhibits higher base number retention property under nitrogen oxide gas atmosphere (e.g. in an internal combustion engine), resulting in longer use of lubricating oil.

A base number (hydrochloric acid method) of a sample oil having a sulfated ash content of 0.8 to 0.9 mass % was measured 96 hours later and 144 hours later. A base number (hydrochloric acid method) of a sample oil having a sulfated ash content of 0.5 to 0.6 mass % was measured 48 hours later and 96 hours later.

[FALEX Load Resistance Characteristics Test]

Seizure loads when using the sample oils were respectively measured based on ASTM D3233. Specifically, after break-in was conducted for 5 minutes (a pin material: AISI-3153, a block material: AISI-1137, oil quantity: 300 ml, rotation: 290 rpm, oil temperature: 100 degrees C., and load: 1112N), load was continuously increased at oil temperature of 100 degrees C. to measure seizure load. Larger seizure load suggests higher load resistance characteristics of the lubricating oil.

[Shell Wear Test]

Wear resistance for each sample oil was evaluated based on ASTM D2783. Specifically, measurement was conducted under conditions of rotation: 1200 rpm, oil temperature: 80 degrees C., load: 392N and wearing period: 30 minutes.

The properties of sample oils (the lubricating oil compositions) and the results of the evaluation test are shown in Tables 1 and 2.

TABLE 1

| | | Example 1 | Example 2 | Example 3 | Example 4 | Example 5 |
|---|---|---|---|---|---|---|
| Composition (mass %) | lubricant base oil A(100N mineral oil) | 83.40 | 84.20 | — | — | — |
| | lubricant base oil B(500N mineral oil) | — | — | 85.00 | 85.44 | 84.83 |
| | phosphate ester compound A | 2.1 | — | 1.1 | — | — |
| | phosphate ester compound B | — | 1.3 | — | 0.66 | — |
| | phosphate ester compound C | — | — | — | — | 1.15 |
| | organic acid zinc salt for boost | — | — | — | — | 0.12 |
| | anti-wear agent A | — | — | — | — | — |
| | anti-wear agent B | — | — | — | — | — |
| | metal detergent A | 3 | 3 | — | — | — |
| | metal detergent B | 0.6 | 0.6 | 0.6 | 0.6 | 0.6 |
| | metal detergent C | — | — | 1.45 | 1.45 | 1.45 |
| | ashless dispersant A | 4 | 4 | — | — | — |
| | ashless dispersant B | — | — | 4.5 | 4.5 | 4.5 |
| | ashless dispersant C | — | — | 1.5 | 1.5 | 1.5 |
| | antioxidant | 1.7 | 1.7 | 3 | 3 | 3 |
| | viscosity index improver A | 4.5 | 4.5 | — | — | — |
| | viscosity index improver B | — | — | 2.45 | 2.45 | 2.45 |
| | pour point depressant | 0.3 | 0.3 | — | — | — |
| | others | 0.4 | 0.4 | 0.4 | 0.4 | 0.4 |
| | TOTAL | 100 | 100 | 100 | 100 | 100 |
| Properties | sulfated ash content (mass %) | 0.87 | 0.83 | 0.55 | 0.54 | 0.57 |
| | P content (mass %) | 0.077 | 0.079 | 0.04 | 0.04 | 0.04 |
| | Zn content (mass %) | 0.120 | 0.094 | 0.061 | 0.048 | 0.06 |
| | Zn/P ratio | 0.74 | 0.56 | 0.72 | 0.57 | 0.71 |
| NOx resistance (base number before/after NOx degradation Test: mgKOH/g) | initial | 4.95 | 4.83 | 4.17 | 4.05 | 4.31 |
| | 48 hours later | — | — | 2.19 | 2.05 | 1.82 |
| | 96 hours later | 2.52 | 2.14 | 1.13 | 1.02 | 0.87 |
| | 144 hours later | 1.28 | 1.06 | — | — | — |
| FALEX load resistance characteristics (N) | | 4600 | 4500 | 4200 | 4050 | 4250 |
| Shell wear (mm) | | 0.45 | 0.46 | 0.40 | 0.42 | 0.41 |

TABLE 2

| | | Comparative 1 | Comparative 2 | Comparative 3 | Comparative 4 | Comparative 5 |
|---|---|---|---|---|---|---|
| Composition (mass %) | lubricant base oil A(100N mineral oil) | 84.55 | 84.47 | — | — | — |
| | lubricant base oil B(500N mineral oil) | — | — | 84.95 | 85.60 | 85.57 |
| | phosphate ester compound A | — | — | — | — | — |
| | phosphate ester compound B | — | — | — | — | — |
| | phosphate ester compound C | — | — | 1.15 | — | — |
| | organic acid zinc salt for boost | — | 0.5 | — | — | 0.26 |
| | anti-wear agent A | 0.95 | — | — | 0.5 | |
| | anti-wear agent B | — | 0.53 | — | — | 0.27 |
| | metal detergent A | 3 | 3 | — | — | — |
| | metal detergent B | 0.6 | 0.6 | 0.6 | 0.6 | 0.6 |
| | metal detergent C | — | — | 1.45 | 1.45 | 1.45 |
| | ashless dispersant A | 4 | 4 | — | — | — |
| | ashless dispersant B | — | — | 4.5 | 4.5 | 4.5 |
| | ashless dispersant C | — | — | 1.5 | 1.5 | 1.5 |
| | antioxidant | 1.7 | 1.7 | 3.0 | 3.0 | 3.0 |
| | viscosity index improver A | 4.5 | 4.5 | — | — | — |
| | viscosity index improver B | — | — | 2.45 | 2.45 | 2.45 |
| | pour point depressant | 0.3 | 0.3 | — | — | — |
| | others | 0.4 | 0.4 | 0.4 | 0.4 | 0.4 |
| | TOTAL | 100 | 100 | 100 | 100 | 100 |
| Properties | sulfated ash content (mass %) | 0.84 | 0.83 | 0.53 | 0.54 | 0.53 |
| | P content (mass %) | 0.078 | 0.078 | 0.04 | 0.04 | 0.04 |
| | Zn content (mass %) | 0.086 | 0.081 | 0.04 | 0.045 | 0.042 |
| | Zn/P ratio | 0.52 | 0.49 | 0.47 | 0.53 | 0.50 |
| NOx resistance (base number | initial | 5.12 | 5.08 | 3.98 | 4.76 | 4.86 |
| | 48 hours later | — | — | 1.17 | 0.82 | 1.24 |

TABLE 2-continued

| | Comparative 1 | Comparative 2 | Comparative 3 | Comparative 4 | Comparative 5 |
|---|---|---|---|---|---|
| before/after NO*x* 96 hours later | 0.84 | 1.79 | 0.67 | 0.29 | 0.72 |
| degradation Test: 144 hours later | 0.00 | 1.05 | — | — | — |
| mgKOH/g) | | | | | |
| FALEX load resistance characteristics (N) | 4350 | 2950 | 3950 | 4300 | 3250 |
| Shell wear (mm) | 0.46 | 0.71 | 0.43 | 0.4 | 0.53 |

[Evaluation Results]

As is understood from the evaluation result of Table 1, Examples 1 to 5 using the lubricating oil composition of the invention exhibit significantly excellent base number retention characteristics as well as the same wear resistance as Comparatives 1 and 4 using ZnDTP as an anti-wear agent because a Zn/P ratio is 0.55 or more in the total composition in addition to the presence of the predetermined phosphate ester compound as the anti-wear agent. Particularly, it is understood that the lubricating oil compositions in Examples 3 to 5, in which ash content was lowered (an initial base number was low), exhibit high base-number retention property and sufficient long-drain capabilities.

On the other hand, it is understood that Comparatives 1 to 5 exhibit deteriorated NOx resistance, regardless of sulfated ash contents. Moreover, even though the phosphate ester compound is contained as the component (D) of the invention, Comparative 3 in which the Zn/P ratio in the total composition was less than 0.55 does not exhibit sufficient NOx resistance.

The invention claimed is:

1. A lubricating oil composition, comprising:

a lubricant base oil;

a phosphate ester derivative represented by formula (1) below:

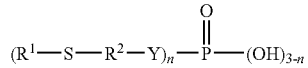

(1)

wherein: Y represents S (sulfur) or O (oxygen); $R^1$ represents an organic group having 4 to 24 carbon atoms; $R^2$ represents a divalent organic group having 1 to 6 carbon atoms; and n represents an integer of 1 to 3;

a zinc compound, wherein an element ratio (Zn/P) between zinc (Zn) and phosphorus (P) in the lubricating oil composition is 0.55-1 at a mole ratio, and a metal detergent, a content of the metal detergent being 0.02-0.1941 mass % in terms of metal based on a total amount of the lubricating oil composition, wherein a sulfated ash content of said composition is 1 mass % or less of the total amount of the composition, Y in the phosphate ester derivative of the formula (I) represents O (oxygen), a phosphorus content is 0.12 mass % or less of the total amount of the composition, the zinc compound is at least one compound selected from the group consisting of metal zinc, a zinc oxide, an organic zinc compound, a zinc oxoacid salt, a zinc halide and a zinc complex, the metal detergent is at least one of alkali metal salicylate and alkali earth metal salicylate, and wherein the lubricating oil composition further comprises at least one additive selected from the group consisting of an ashless dispersant, a phenol antioxidant, an amine antioxidant, a metal deactivator and an anti-emulsifier.

2. The lubricating oil composition according to claim 1, wherein a sulfated ash content is 0.6 mass % or less of the total amount of the composition.

3. An internal combustion engine comprising the lubricating oil composition according to claim 1.

4. The internal combustion engine according to claim 3, wherein a sulfur content of fuel used in the internal combustion engine is 20 mass ppm or less.

5. The lubricating oil composition according to claim 1, wherein the element ratio (Zn/P) between zinc (Zn) and phosphorus (P) in the lubricating oil composition is 0.58-1 at a mole ratio.

* * * * *